US005169001A

United States Patent [19]

Scheibel

[11] Patent Number: 5,169,001

[45] Date of Patent: Dec. 8, 1992

[54] MEDICAMENT DISPENSING CONTAINER

[76] Inventor: David H. Scheibel, 147 Airport Hwy., Swanton, Ohio 43558

[21] Appl. No.: 732,590

[22] Filed: Jul. 19, 1991

[51] Int. Cl.[5] ..... B65D 83/04

[52] U.S. Cl. ..... 206/425; 206/534; 206/535; 206/531; 206/461; 211/51

[58] Field of Search ..... 206/526, 461, 425, 534, 206/535, 536, 531, 828, 462; 211/51, 50; 220/532, 533

[56] References Cited

U.S. PATENT DOCUMENTS

| | | | |
|---|---|---|---|
| 3,313,407 | 4/1967 | Palm, Jr. | 206/526 X |
| 3,540,786 | 11/1970 | Potter | 220/532 X |
| 3,856,137 | 12/1974 | Brindley | 206/462 X |
| 3,952,872 | 4/1976 | Consiglio, Jr. | 206/526 |
| 4,473,156 | 9/1984 | Martin | 206/534 |
| 4,544,213 | 10/1985 | Long et al. | 220/532 X |
| 4,545,484 | 10/1985 | Rohner | 206/425 |
| 4,572,547 | 2/1986 | Phillips | 206/425 X |
| 4,795,196 | 1/1989 | Hyun et al. | 211/50 X |
| 4,889,238 | 12/1989 | Batchlor | 206/535 |

*Primary Examiner*—David T. Fidei
*Assistant Examiner*—Jacob K. Ackun, Jr.
*Attorney, Agent, or Firm*—Marshall & Melhorn

[57] ABSTRACT

A container for a plurality of medicaments to be used in a therapeutic regimen for a patient to facilitate the prescribed sequence and interval of application. The container includes a plurality of generally planar blister cards having medicament containing cavities. Each blister card is adapted to contain a single medicament, and is provided with a marginal region for receiving medicament and administration indicia. The container is further provided with a base for retaining the plurality of blister cards in a generally vertical position with the marginal region of the blister cards extending upmost. The blister cards are retained in sequential arrangement by the prescribed time of day of administration of the medicament contained in each blister card.

4 Claims, 2 Drawing Sheets

MEDICAMENT DISPENSING CONTAINER

BACKGROUND OF THE INVENTION

1. Field of the Invention

The present invention pertains to containers for storing a plurality of medicaments to be used in a therapeutic regimen for a patient, and more particularly, to a container for storing a plurality of medicament containing blister cards to facilitate the prescribed sequence and interval of application of the medicaments.

2. Description of Related Art

The treatment of various medical disorders often involves a complex therapeutic regimen where the patient is required to take certain medications on certain days and at certain times of the day. The patient may be required to take a given medicament only at certain points in the regimen, and other medicaments at other points in the regimen. The resulting complexity of the required therapeutic regimen results in low overall patient compliance. Furthermore, it is generally difficult for the prescribing physician to assess the degree of patient compliance with the prescribed regimen.

Many systems have been developed which utilize blister cards having indicia indicating the particular time when a particular medicament is to be taken. U.S. Pat. No. 4,295,567 to Knudsen discloses a blister card holding two different medicaments. The blister card includes indicia along one axis of the card indicating that a first medicament is to be taken during the day and the second at night. Indicia representing the consecutive days of therapy are imprinted along the other axis.

U.S. Pat. No. 4,736,849 to Leonard et al is directed to a calendar-oriented pill dispenser comprising a blister card containing a complete cycle of several different medicaments. Indicia are provided which relate each pill or group of pills with a given day of the month. The blister card is folded in half to reduce its size.

The effectiveness of these blister cards is limited by the practical limitations of the dimensions of the card. Problems arise when a complete cycle of treatment cannot be conveniently placed entirely on one blister card.

Additionally, there are disadvantages where more than one medicament is included on a single blister card. With multiple medicaments in a single card, all of the medicaments are wasted should a dosage change become necessary or the patient become allergic to one of the medicaments contained in the card. On the other hand, if each blister card contains only a single medicament, only the effected card need be returned.

A medicament package including a plurality of blister cards carrying various medicaments is disclosed in U.S. Pat. No. 4,889,238 to Batchelor. A base provides lateral support to the edges of the blister cards, which are placed in a stacked array with the principal dimensions thereof oriented generally horizontally. The blister cards are arranged in order of use with the first to be used topmost. Each blister card generally contains indicia denoting the order and sequence when the contents of a particular blister cavity are to be taken. The base of the package permits direct and unobstructed access to the uppermost blister card and limited access only to the edges of the blister card.

In the package disclosed in the Batchelor patent, only the blister card currently being used, the topmost card, is exposed for removal by the patient. This is disadvantageous when each blister card carries only a single type of medicament, and the patient's regimen requires the daily administration of several different medicaments, because only the topmost card is accessible.

SUMMARY OF THE INVENTION

In accordance with present invention, there is provided a container for a plurality of medicaments to be used in a therapeutic regimen for a patient to facilitate the prescribed sequence and interval of application. The container includes a plurality of generally planar blister cards having medicament containing cavities. Each blister card is adapted to contain a single medicament, and is provided with a marginal region for receiving medicament and administration indicia. The container is further provided with a base for retaining said plurality of blister cards in a generally vertical position with the marginal region of the blister cards extending upmost. Further, the blister cards are retained in sequential arrangement by the prescribed time of day of administration of the medicament contained in each blister card.

It is an object of the present invention to provide a medicament dispensing container which increases patient compliance with a complex therapeutic regimen;

It is also an object of the invention to provide such a container for a plurality of blister cards each containing a single type of medicament;

Another object of the invention is to provide such a container which permits access to all of the cards in the container at one time;

Still another object of the invention is provide a container which easily allows the prescribing physician to evaluate the degree of patient compliance with the regimen;

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENT

Figure 1:
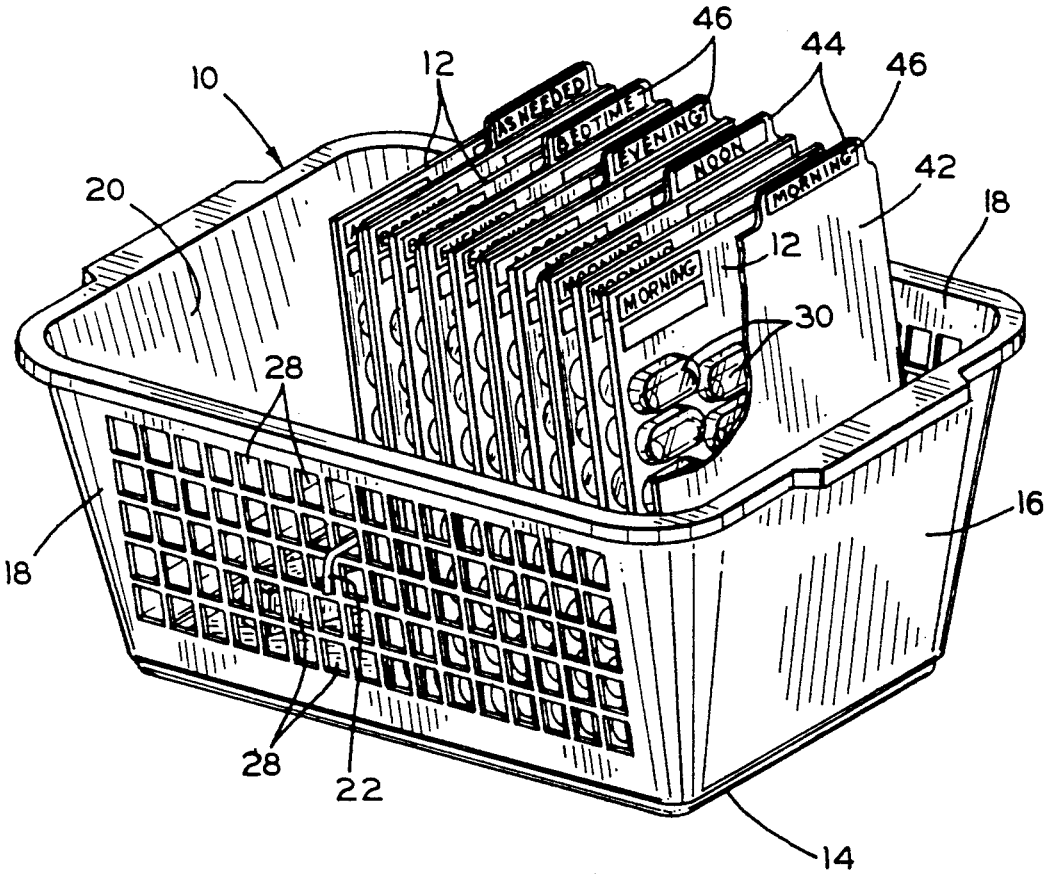
FIG. 1 is a perspective view of the medicament dispensing container of the present invention.

Referring now to the drawings, there is illustrated in FIG. 1 a medicament dispensing container embodying the present invention. The medicament dispensing container includes a base 10 with a plurality of generally planar blister cards 12 retained therein.

The base 10 more particularly includes a bottom wall 14, from which depends a front wall 16, two opposing side walls 18, and a back wall 20. The distance between the two opposing side walls 18 is preferably only slightly larger than the width of the individual blister cards 12 to facilitate the retention of the blister cards 12 in a stacked array with the principle dimensions of the blister cards 12 disposed generally vertically. The distance between the front wall 16 and back wall 20 need only be large enough to hold the number of blister cards required for the prescribed regimen.

The bottom wall 14, front wall 16, side walls 18, and back wall 20 may be composed of any suitable material, such as wood, metal, plastic, cardboard or the like. Preferably, the entire base 10 is molded of a single plastic material.

Figure 2:
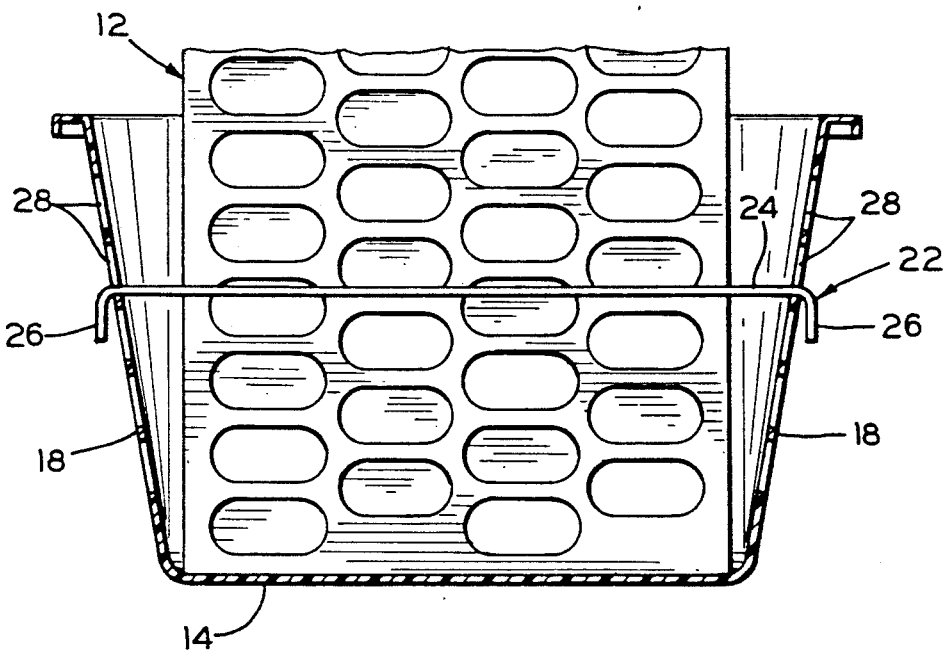
FIG. 2 is a cross sectional view of the medicament dispensing container.

In the preferred embodiment, the base 10 is additionally provided with a horizontally disposed support member 22 extending between the opposing side walls 18 to support the blister cards 12 in a generally vertical position. As best seen in FIG. 2, the support member 22 is comprised of a shaft 24 terminating at each end in a hook 26. Each side wall 18 is provided with a series of apertures 28 adapted to receive the hooks 26 of the support member 22. Each aperture 28 in a side wall 18 is positioned directly opposite a corresponding aperture 28 in the opposing side wall 18, so that the shaft 24 of the support member 22 is retained substantially perpendicular to the side walls 18. The hooks 26 of the support member 22 may be positioned in various pairs of corresponding apertures 28 in order to adjust the distance between the support member 22 and the front wall 16 of the base 10.

Where the base 10 is provided with a support member 22, the distance between the front wall 16 and the back wall 20 is preferably somewhat larger than is necessary to hold the number of blister cards 12 required for a particular regimen. The support member 22 is positioned along the length of the side walls 18 at point between the backmost of the blister cards 12 and the back wall 20 of the base 10. The support member 22 should be positioned near enough the front wall 16 that the blister cards 12 are kept from leaning backwards and are thereby retained in a generally vertical position, but not so near the front wall 16 that the blister cards 12 are difficult to remove.

Some medicaments, such as an ointment or liquid, are not readily stored in blister cards, but may still be an important part of a particular therapeutic regimen. Conveniently, a space is created in the base 10 between the backmost of the blister cards 12, which is held in place by support member 22, and the back wall 20 in which a variety of such medicaments may be placed. In this way, all of the different medicaments for a given therapeutic regimen may be retained in a single container.

Figure 3:
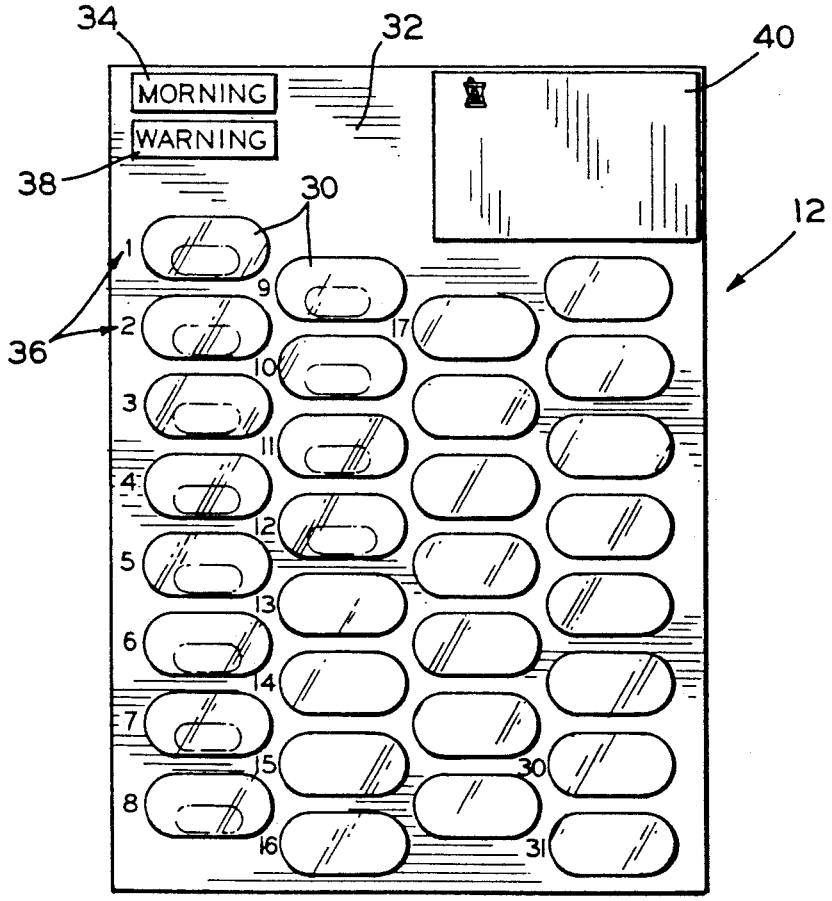
FIG. 3 is a plan view of a blister card.

FIG. 3 provides an illustration of an individual blister card 12, the general structure of which is well know in the art. The blister cards 12 are generally planar and are preferably substantially rectangular in shape. The blister cards 12 can comprise a clear film layer having medicament containing blister cavities 30 heat-sealed to a foil layer. Each blister card 12 contains only a single type of medicament, with each blister cavity 30 containing a single dose of the medicament.

Each blister card 12 is provided with a marginal region 32 for receiving various indicia regarding the particular medicament contained therein and its administration. The dimensions of the blister cards 12 should be such that the marginal region 32 of each blister card 12 extends above at least one of the front wall 16 or side walls 18 of the base 10. The marginal region 32 of each blister card 12 preferably extends above both the front wall 16 and the side walls 18 of base 10 for ease of accessibility.

The marginal region 32 of each blister card 12 is provided with indicia 34 representing the time of day when the contents of the particular blister card 12 are to be taken by the patient. Preferably, the indicia 34 are color-coded by the time of day to further aid the user in compliance with the prescribed regimen. Thus, each blister card 12 containing a medicament which is to be consumed in the morning, is provided with indicia 34 having the word "MORNING" printed on a distinctly colored background. Likewise, blister cards 12 containing medicaments to be taken at other times of the day are provided with indicia 34 indicating, for example, "NOON", "EVENING", "BEDTIME", "AS NEEDED", in accordance with the prescribed regimen. The indicia 34 representing each time of the day is printed on a differently colored background.

Each blister card 12 is additionally provided with indicia 36 adjacent each blister cavity 30 representing the day of the month when the contents of the particular blister cavity 30 are to be taken by the patient. Such indicia 36 preferably denote the calendar day of a given month. Accordingly, each blister card 12 is adapted to include thirty one blister cavities 30, which is sufficient to hold one month's supply of a particular medicament to be taken at a particular time of day. Obviously, for months having fewer than thirty one days, the appropriate number of blister cavities 30 are left empty. Likewise, should the regimen not be initiated at the beginning of a calendar month, those blister cavities denoted by indicia 36 for the calendar days prior to the date of initiation are left empty.

Further indicia, such as any particular warning 38 or further instruction 40 as to proper administration of the medicament, may be included in the marginal region 32 of the blister card 12.

The blister cards 12 are placed in a stacked array in the base 10 with the principal dimensions of the cards 12 disposed generally vertically. The blister cards 12 are arranged by order of use, with the first to be used nearest the front wall 16 of the base 10. Each blister card 12 is positioned with the marginal region 32 having indicia 34, 36, 38, and 40 printed thereon, towards the front wall 16.

In the preferred embodiment, the medicament dispensing container of the present invention also includes a plurality of generally planar dividers 42, for separating the blister cards 12 by the prescribed time of day of administration of the medicament contained in each blister card 12. Like the blister cards 12, the dividers 36 are retained in the base 10 and are therefore preferably of the same general dimensions as the blister cards 12.

Each divider 42 is provided with a tab 44 extending from the uppermost edge of the divider 42. When positioned in the base 10, the tab 44 of the divider 42 should extend beyond the uppermost edge of the adjacent blister cards 12 so that the tab 44 is easily visible and may be readily grasped by the patient. The tab 44 for each divider 42 includes indicia 46, preferably identical to the indicia 34 in the marginal region 32 of the blister cards 12, representing a particular time of day. Advantageously, the indicia 46 are color-coded to match the colors of the corresponding indicia 34.

In use, the blister cards 12, each containing only a single medicament, are arranged in a stacked array in the base 10 by order of use and in accordance with the indicia 34. The blister cards 12 are thus grouped by the time of day of administration, and a divider 36 is provided in front of the forwardmost blister card 12 of each of such groups. Any required medicament which is not readily stored in a blister card 12, is placed in the base 10 behind the backmost blister card 12 and the support member 22. A card (not shown), containing medicament and administration indicia for such medicament, may be included in the stacked array of blister cards in order to remind the patient regarding the prescribed administration of the medicament.

In the morning, for example, the patient would remove from the base 10 all those blister cards 12 which have indicia 34 indicating that the medicament contained therein is to be taken in the morning. To aid the patient, such indicia 34 are color-coded by the time of day of administration. The selection of the appropriate blister cards 12 is additionally aided by the dividers 42; that is, the patient selects those blister cards 12 positioned between the divider 42 having indicia 46 indicating the morning and the next divider 36. The patient then takes the medicament, if any, contained in the particular blister cavity 30 adjacent the indicia 36 representing the present calendar date. The blister cards 12 are then easily replaced in the correct position between the appropriate dividers 42. The process is repeated at various other times of the day as prescribed.

Upon a review of the container, the prescribing physician can easily assess the level of patient compliance with the prescribed regimen. By noting specifically which blister cavities 30 have not been emptied, the physician is able to determine which medicaments were not taken, and on what day and time of the day such administration was omitted.

It is to be understood that the form of the invention herewith shown and described is to be taken as an illustrative embodiment only, and that various changes in the shape, size and arrangement of the elements may be resorted to without departing from the spirit of the invention.

What is claimed is:

1. A container for a plurality of medicaments to be used in a therapeutic regimen by a patient for facilitating the prescribed sequence and interval of application, the container having a bottom wall, two opposing side walls between a generally vertical front wall and a back wall, the container comprising:

a) a plurality of generally planar blister cards having medicament contained in a plurality of blister cavities on said cards, each blister cavity containing a single medicament, and each blister card being provided with a marginal region having medicament and administration indicia located thereon;

b) a plurality of dividers, each divider provided with a marginal region having indicia of a particular time of day located thereon, the cards being in a generally vertical position, generally perpendicular to the side walls; and c) a generally moveable support member extending between the container sidewalls and comprising a rod with a hook on each end of the rod, each hook cooperating with a respective aperture in the sidewall adjacent each end of the rod, to secure the respective ends of the rod said rod thereby retaining said plurality of blister cards and said plurality of dividers in a generally vertical, sequential arrangement with the marginal region of the blister cards and the marginal region of the dividers extending upmost, the dividers being arranged so as to separate the blister cards by the prescribed time of day of administration of the medicament contained in each blister card.

2. A container as defined in claim 1 in which there is access to each of the vertically disposed blister cards and each card has 31 blister cavities.

3. A container as defined in claim 1 in which each blister card has indicia indicating the time of day of administration and blister each card is accessible and easily removed according to the time of day indicia.

4. A container as defined in claim 1 in which dividers are positioned to provide a group of blister cards having the same time of day indicia.

* * * * *